US006925696B1

(12) United States Patent
Williams

(10) Patent No.: US 6,925,696 B1
(45) Date of Patent: Aug. 9, 2005

(54) BRAKE ROTOR PULLER

(75) Inventor: William A. Williams, Rochester, NY (US)

(73) Assignee: Pro-Cut International, LLC, West Lebanon, NH (US)

( * ) Notice: Subject to any disclaimer, the term of this patent is extended or adjusted under 35 U.S.C. 154(b) by 42 days.

(21) Appl. No.: 10/779,955

(22) Filed: Feb. 13, 2004

(51) Int. Cl.[7] ..... B25B 27/02
(52) U.S. Cl. ..... 29/252
(58) Field of Search ..... 29/261, 262, 252, 29/239

(56) References Cited

U.S. PATENT DOCUMENTS

| | | | | |
|---|---|---|---|---|
| 1,581,057 | A | | 4/1926 | Hill |
| 1,777,616 | A | | 10/1930 | Hommel |
| 2,003,648 | A | | 6/1935 | Frye et al. |
| 2,003,756 | A | | 6/1935 | Nagel |
| 2,262,969 | A | | 11/1941 | Schultz |
| 3,069,761 | A | | 12/1962 | Sommer |
| 3,337,943 | A | * | 8/1967 | Powell ..... 29/252 |
| 3,402,455 | A | * | 9/1968 | Converse ..... 29/261 |
| 3,908,258 | A | | 9/1975 | Barty |
| 5,159,743 | A | | 11/1992 | Somerville |
| 5,167,057 | A | | 12/1992 | Somerville |
| 5,233,740 | A | | 8/1993 | Chen |
| 5,419,027 | A | | 5/1995 | McPeak et al. |
| 5,896,639 | A | | 4/1999 | Chen |

* cited by examiner

*Primary Examiner*—Robert C. Watson
(74) *Attorney, Agent, or Firm*—Michael J. Weins; Jeffrey E. Semprebon

(57) ABSTRACT

A rotor puller has two arm members, ending at claws, and a jack with an extendible piston. The arm members and the jack are pivotably attached together about a pivot axis. Springs bias the arm members toward each other. The claws are placed over a brake rotor and retained thereon by a pin. After the claws have been placed, the jack is centered and activated to extend the piston towards the claws. The piston forcibly engages a wheel hub while the claws forcibly engage the rotor, pulling it from the wheel hub. Handles on the arm members facilitate placement of the claws over the rotor.

20 Claims, 4 Drawing Sheets

BRAKE ROTOR PULLER

FIELD OF THE INVENTION

The present invention is a puller for removing an object from a shaft on which it is mounted, and more particularly for a puller that is well suited for use removing a vehicle brake rotor from a wheel hub.

BACKGROUND OF THE INVENTION

Vehicle disk brakes employ a rotor surrounding each wheel hub as a friction surface that is engaged by calipers to apply a braking force to a wheel mounted on the wheel hub. These rotors become worn with prolonged use and periodically need to be replaced. When the rotor has become so worn as to require replacement, it is frequently found to be affixed to the wheel hub by dirt and corrosion, making removal of the rotor difficult. A device for mechanically forcing the rotor from the hub is desirable to facilitate removal.

A classic device for removing an object from a shaft is known as a gear puller, which employs two or more arm members that engage a shaft-mounted gear, and an extendible member that engages the shaft. A screw mechanism forces the extendible member toward the gear, and the engagement of the arm members with the gear causes the gear to be forced to the end of the shaft. If the extendible member has a terminal portion with a diameter less than that of the shaft, the gear can be further forced to remove it from the shaft.

One early mechanical wheel puller is taught in U.S. Pat. No. 3,337,943, which teaches a wheel puller having an overall configuration similar to a classical gear puller, but with a hydraulic piston replacing the screw mechanism. The puller has a hydraulic cylinder with an extendible ram and two pivotably attached and opposed claws. In use, the claws are placed behind the wheel, pulley, or similar shaft-mounted object, while the ram is placed against the end of the shaft. The cylinder is then operated to extend the ram toward the ends of the claws, which causes the claws to forcibly engage and remove the wheel or pulley from the shaft. Similar hydraulic pullers are taught in U.S. Pat. Nos. 1,581,057; 1,777,616; 2,003,648; 2,003,756; 2,262,969; 5,159,743; 5,167,057; 5,233,740; 5,419,027; and 5,896,639. These devices require considerable care and effort in correctly placing the arm members to engage the shaft-mounted object as the extendible member is extended. Correct placement of the arm members is further complicated in the case of vehicle brake rotors, since these rotors typically are recessed in a wheel well of the vehicle and there is typically surrounding structure, such as brake calipers, that severely limits access to the rotor.

U.S. Pat. Nos. 3,069,761 and 3,908,258 teach hydraulic pullers with arm members which have adjustment mechanisms to assist in placing the arm members into the proper position for engagement with a shaft-mounted object. However, in both devices the adjustment mechanism is bulky and would not appear to be suitable for use where clearances are limited, such as for use removing vehicle brake rotors.

Thus, there is a need for a puller which facilitates placement of the pivoting members with respect to the rotor, even in situations where clearance about the rotor is limited.

SUMMARY OF THE INVENTION

The rotor puller of the present invention facilitates removing a brake rotor from a wheel hub of a vehicle onto which the brake rotor is mounted. The rotor puller has a pair of arm members with claws for engaging the brake rotor and a jack with an extendible piston for engaging the wheel hub.

The arm members each terminate at an arm base end and an arm work end. The arm base ends of the arm members are pivotably attached with respect to each other about a pivot axis, while the arm work ends each terminate at one of the claws.

Spring means for biasing the arm members together are provided. The spring means are preferably provided by a pair of arm springs which are mounted between the arm members at a location between the arm base ends and the arm work ends such that the arm springs are tensioned when the arm members are pivoted apart.

The jack is pivotably connected to the arm members so as to pivot with respect thereto about the pivot axis. Thus, when the claws of the arm members are engaged with the brake rotor, the jack can be pivoted to align it with the wheel hub. Preferably, a pivot handle is connected to the jack to facilitate adjusting its inclination with respect to the arm members.

Preferably, each of the arm members has an arm handle for grasping by the user to facilitate moving the arm members against the bias of the spring means. The arm handles preferably extend substantially parallel to the pivot axis, and are set back somewhat from the claws to facilitate placing the claws over the brake rotor when clearance about the brake rotor is limited. An arm stop is preferably mounted to one of the arm members and configured to engage the other so as to limit the minimum separation between the arm members.

The claws are configured to be forcibly engageable with the brake rotor. Typically, the brake rotor has a rotor rear surface that is planar, in which case each claw has a claw surface which faces the arm base end. Thus, when the claws are placed over the brake rotor, the claw surfaces are opposed to the rotor rear surface.

While the force of the spring means is typically sufficient to hold the claws in place on the rotor, for more positive retention it is preferred for one of the claws to have a pin passage therethrough that is spaced apart from the claw surface a sufficient distance to accommodate the thickness of the brake rotor. A retainer pin can be inserted into the pin passage to trap the brake rotor between the retainer pin and the claw surface to help maintain the claws in position on the brake rotor while the jack is operated.

When the jack is activated, the piston of the jack extends away from the pivot axis, toward the claws. To retract the piston after it has been extended, it is preferred to provide piston return means, such as one or more piston return springs that are tensioned as the piston is extended. It is also preferred to provide means for maintaining the pivotal position of the jack with respect to at least one of the arm members, to keep the jack in alignment while the operator is free to activate the jack to extend the piston.

To prevent damage to the wheel hub, it is preferred to mount a hub adapter onto the piston that is configured for engaging the specific style of wheel hub. The piston can be provided with an adapter mount that allows various hub adapters to be mounted to match the vehicle from which the rotor is being removed.

To place the rotor puller in position to remove the brake rotor, the arm members are separated against the bias of the spring means and the claws are passed over the rotor. The arm members are then allowed to come together until the claws springably engage the brake rotor, with the claw surfaces opposed to a back surface of the brake rotor. If a retainer pin is employed, it is inserted to positively maintain the claws engaged with the brake rotor.

After the claws have been engaged with the brake rotor, the jack is aligned with the wheel hub. The jack is activated to extend the extendible piston. When the piston extends sufficiently far, it engages the wheel hub. Further extension of the piston brings the piston into forcible engagement with the wheel hub and the claw surfaces of the claws into forcible engagement with the back surface of the brake rotor, at which time further extension of the piston acts to force the rotor off the wheel hub.

BRIEF DESCRIPTION OF THE FIGURES

As shown in FIG. 4, the jack has not yet been activated to extend the piston.

DETAILED DESCRIPTION OF THE PREFERRED EMBODIMENT

Figure 1:
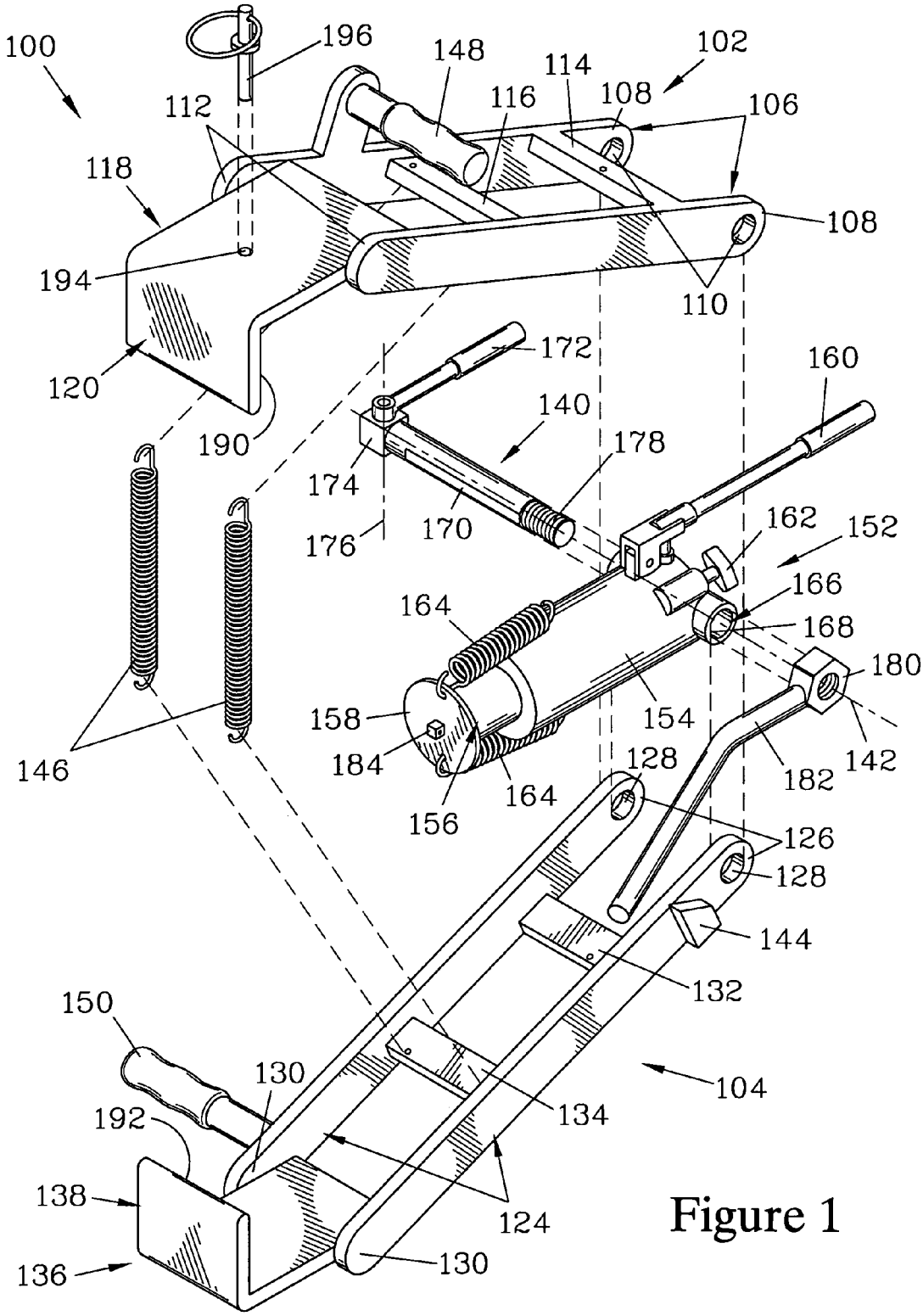
FIG. 1 is an exploded isometric view illustrating the elements of a rotor puller that forms one embodiment of the present invention. The rotor puller has a pair of arm members which, when the rotor puller is assembled, are pivotably attached with respect to each other. The arm members terminate at claws configured to be forcibly engageable with a brake rotor (shown in FIGS. 3–5). The arm members each rotatably engage a pivot shaft that defines a pivot axis, and arm springs serve to bias the arm members together. A jack is mounted on the pivot shaft such that the jack can be pivoted relative to the arm members about the pivot axis by means of a shaft handle affixed to the pivot shaft. The jack has an extendible piston that can be forcibly extended toward the claws, and piston return springs that bias the piston away from the claws.

FIG. 1 is an exploded isometric view of a rotor puller 100 that forms one embodiment of the present invention. The rotor puller 100 is shown assembled in FIGS. 2–6.

The rotor puller 100 has a first arm member 102 and a second arm member 104 that are pivotably connected together when the rotor puller 100 is assembled. The first arm member 102 is formed by a pair of parallel first arm bars 106, each terminating at a first arm bar base end 108, having a first arm pivot passage 110 therethrough, and a first arm bar work end 112. The first arm bars 106 are joined together by a first arm member base crossbar 114, a first arm member mid crossbar 116, and a first claw plate 118 that joins the first arm bars 106 together at their first arm bar work ends 112. The first claw plate 118 is configured to provide a first claw 120 that is positioned to forcibly engage a brake rotor 122 (shown in FIGS. 3–5 and shown in phantom in FIGS. 2 and 6.)

The second arm member 104 is similar in construction to the first arm member 102, and has a pair of parallel second arm bars 124 that each terminates at a second arm bar base end 126, having a second arm pivot passage 128 therethrough, and a second arm bar work end 130. The second arm bars 124 are joined together by a second arm member base crossbar 132, a second arm member mid crossbar 134, and a second claw plate 136 that joins the second arm bars 124 together at their second arm bar work ends 130. The second claw plate 136 is configured to provide a second claw 138 that is positioned to forcibly engage the brake rotor 122.

The first arm member base crossbar 114, the first arm member mid crossbar 116, and the first claw plate 118 are somewhat longer than the second arm member base crossbar 132, the second arm member mid crossbar 134, and the second claw plate 136, such that the separation between the first arm bars 106 is sufficient to accommodate the second arm member 104 residing therebetween, as better shown in FIGS. 2–6. The first arm member 102 and the second arm member 104 are connected together by a pivot shaft 140 that passes through and rotatably engages the first arm pivot passages 110 in the first arm bar base ends 108 and through the second arm pivot passages 128 in the second arm bar base ends 126. The pivot shaft 140 defines a pivot axis 142 about which the arm members (102, 104) rotate. An arm stop 144 is affixed to one of the second arm bars 124 near the second arm bar base end 126. The arm stop 144 is positioned to engage one of the first arm bars 106 to limit the minimum angle between the arm members (102, 104).

Figure 2:
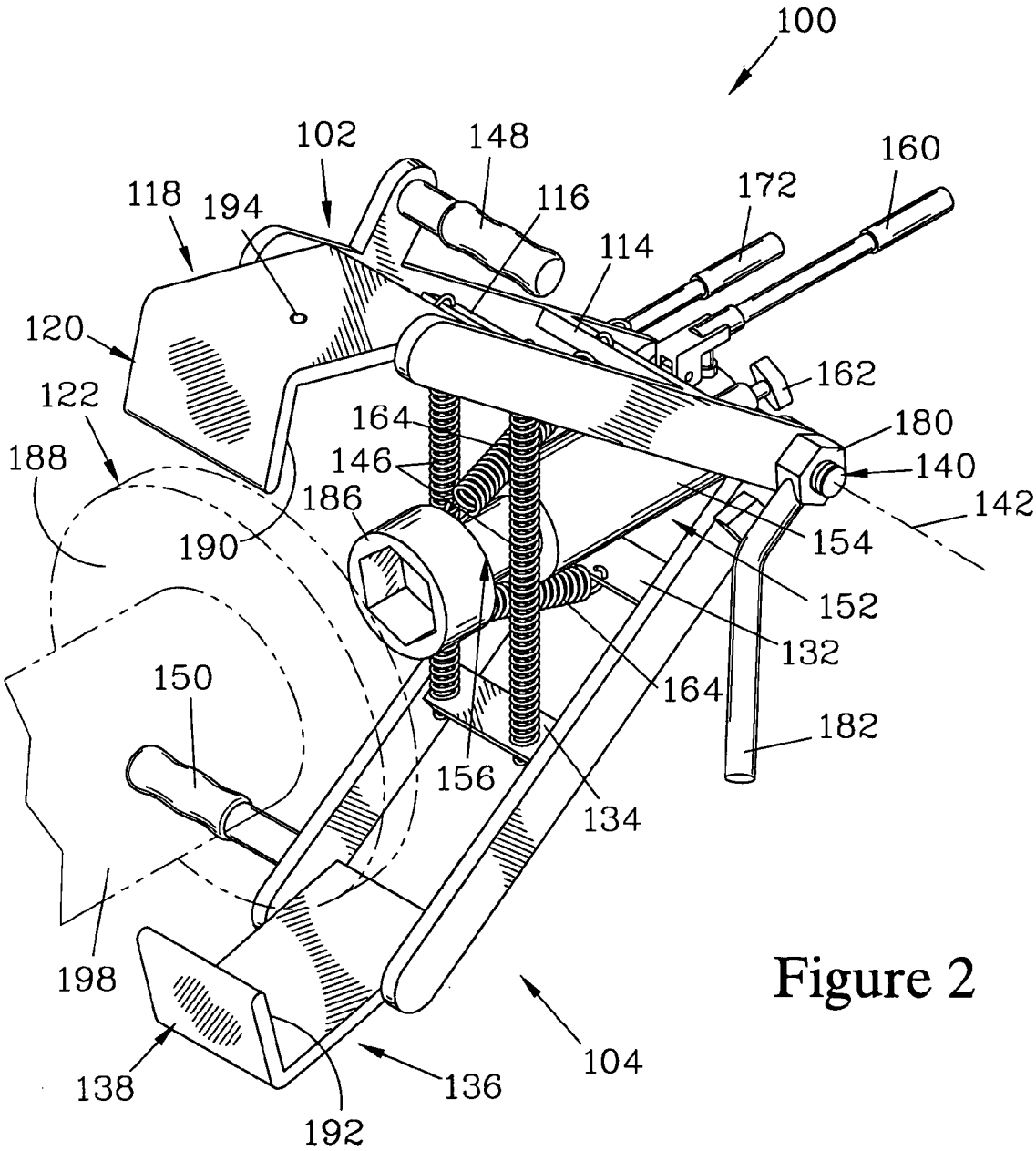
FIG. 2 is an assembled view of the rotor puller shown in FIG. 1 where the arm members have been pivoted apart to allow the claws to be placed over the brake rotor (shown in phantom). The arm members each have an arm handle affixed thereto. The arm handles extend substantially parallel to the pivot axis, and allow a user to readily separate the arm members against the bias of the arm springs. The arm members each have a base crossbar, to which one of the piston return springs is connected, a mid crossbar, to which the arm springs are connected, and a claw plate, on which the claw is formed. A locking nut is provided that threadably engages the pivot shaft. A lock nut handle is affixed to the locking nut to allow the user to tighten the locking nut on the pivot shaft to lock the claws and the jack against pivoting when they are in a desired orientation. A hub adapter has been mounted onto the extendible piston of the jack, the hub adapter being designed to engage a wheel hub about which the brake rotor is mounted.

A pair of arm springs 146 are attached between the first arm member mid crossbar 116 and the second arm member mid crossbar 134. The arm springs 146 are tensioned when the arm members (102, 104) are pivoted apart (as shown in FIG. 2), the spring tension serving to bias the arm members (102, 104) toward each other.

It is preferred to provide a first arm handle 148 attached to the first arm member 102 and a second arm handle 150 attached to the second arm member 104. The first arm handle 148 is mounted to one of the first arm bars 106 and extends parallel with the pivot axis 142. Similarly, the second arm handle 150 is mounted to one of the second arm bars 124 and also extends parallel with the pivot axis 142. Preferably, the first arm handle 148 is positioned above the first arm member 102, while the second arm handle 150 extends outwardly from the second arm member 104, to facilitate placing the rotor puller 100 onto the brake rotor 122 in the orientation shown. This facilitates the operation of a jack 152 by the user after the rotor puller 100 has been placed on the brake rotor 122.

Figure 5:
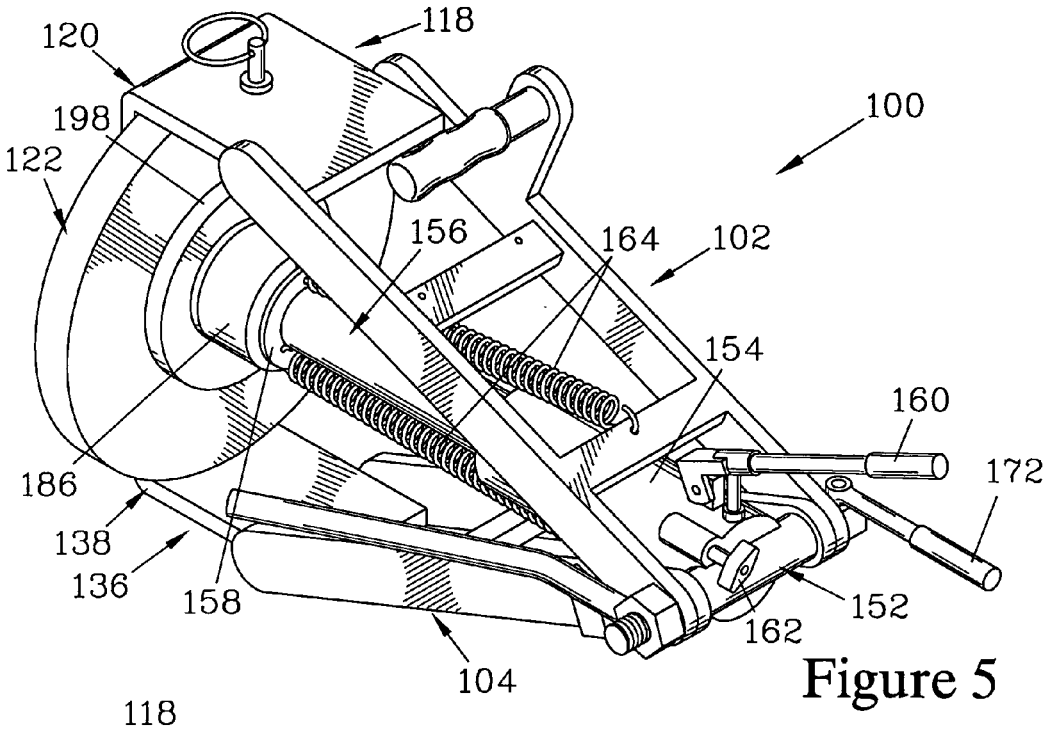
FIG. 5 is an isometric view of the rotor puller shown in FIGS. 1–4 from the same angle as shown in FIG. 4, but where the jack has been activated to extend the piston toward the claws. The piston forcibly engages the wheel hub and causes the claws to forcibly pull the rotor from the wheel hub. The extension of the piston places the piston return springs in tension.

The jack 152 has a jack body 154 that is mounted to the pivot shaft 140 on which the arm members (102, 104) are pivotably mounted. The jack 152 has a piston 156 that extends from the jack body 154 and terminates at a piston end 158. A pump handle 160 and a pressure release knob 162 are mounted on the jack body 154. When the pressure release knob 162 is in a closed position, the pump handle 160 can be operated to forcibly extend the piston 156 from the jack body 154, moving the piston end 158 toward the claws (120, 138), as shown in FIG. 5.

Figure 6:
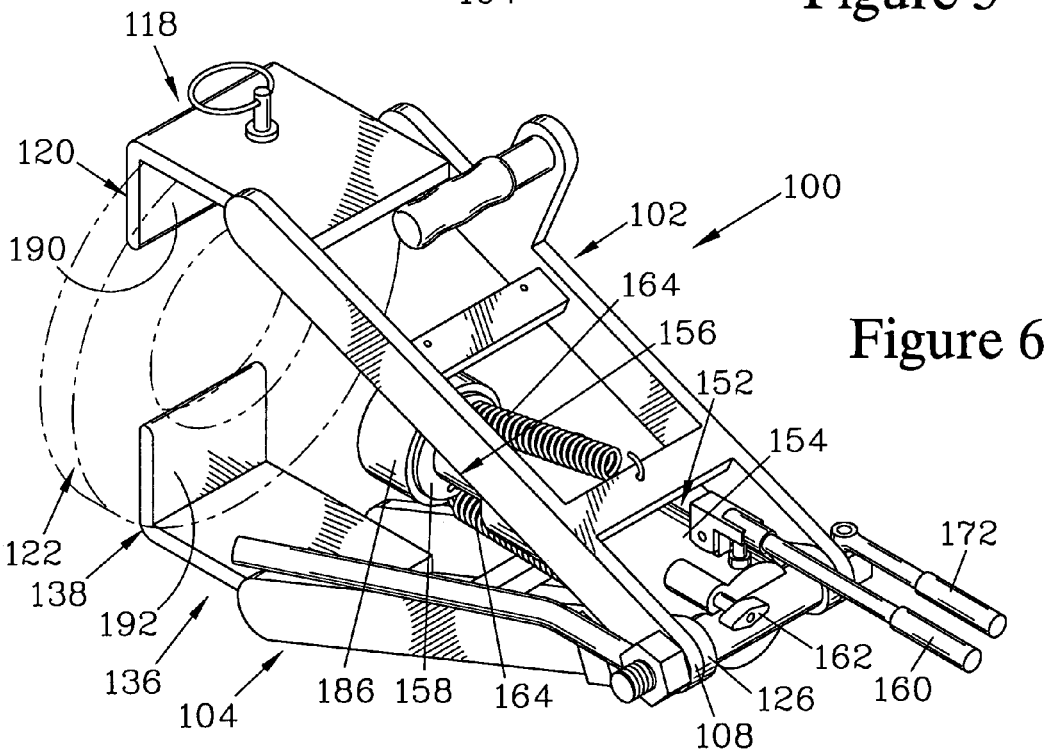
FIG. 6 is an isometric view of the rotor puller shown in FIGS. 1–5 from the same angle as shown in FIGS. 4 and 5, after the brake rotor (shown in phantom) has been removed from the wheel hub. The fluid pressure in the jack has been released, allowing the piston return springs to retract the piston.

When the pressure release knob 162 is turned to an open position, pressure resulting from operation of the pump handle 160 is released, and the piston 156 may be retracted away from the claws (120, 138). In the rotor puller 100, two piston return springs 164 are each connected between the piston end 158 and one of the arm member base crossbars (114, 132), as best shown in FIG. 2. When the piston 156 is extended, the piston end 158 moves toward the claws (120, 138) and away from the arm member base crossbars (114, 132), tensioning the piston return springs 164. When the pressure release knob 162 is turned to the open position, as shown in FIG. 6, the tension of the piston return springs 164 acts to retract the piston 156, retracting the piston end 158 toward the arm member base crossbars (114, 132).

As shown in FIG. 1, the jack body 154 in this embodiment has a jack passage 166 with a key surface 168. The jack passage 166 slidably engages the pivot shaft 140, which is provided with a key flat 170 that engages the key surface 168 to prevent rotation between the jack body 154 and the pivot shaft 140. A pivot handle 172 is mounted to a pivot handle block 174 on one end of the pivot shaft 140. The pivot handle 172 allows an operator to readily adjust the pivotal orientation of the jack 152 relative to the arm members (102, 104). The pivot handle 172 is preferably mounted to the pivot handle block 174 so as to rotate about a shaft handle axis 176 that is normal to the pivot axis 142, allowing it to be folded alongside the arm members (102, 104) for compact storage of the rotor puller 100. For the same reason, it is preferred for the pump handle 160 to be removable.

The pivot shaft 140 is also provided with a threaded portion 178. A locking nut 180 is threadably engaged with the threaded portion 178 of the pivot shaft 140. When the locking nut 180 is tightened on the threaded portion 178, it forcibly compresses the first arm member 102, the second arm member 104, and the jack body 154 between the locking nut 180 and the pivot handle block 174 to lock the first arm member 102, the second arm member 104, and the jack body 154 together. When tightened, the locking nut 180 provides means for maintaining the pivotal position of the jack 152 with respect to the arm members (102, 104). Preferably, a locking nut handle 182 is attached to the locking nut 180 to allow the operator to tighten the locking nut 180 without the use of tools.

The piston end 158 is provided with an adapter mount 184 (shown in FIG. 1), onto which a hub adapter 186 (shown in FIGS. 2–6) can be releasably mounted. The adapter mount 184 is preferably a ½" square drive stub to allow a conventional axle nut socket to be mounted to serve as the hub adapter 186.

Figure 3:
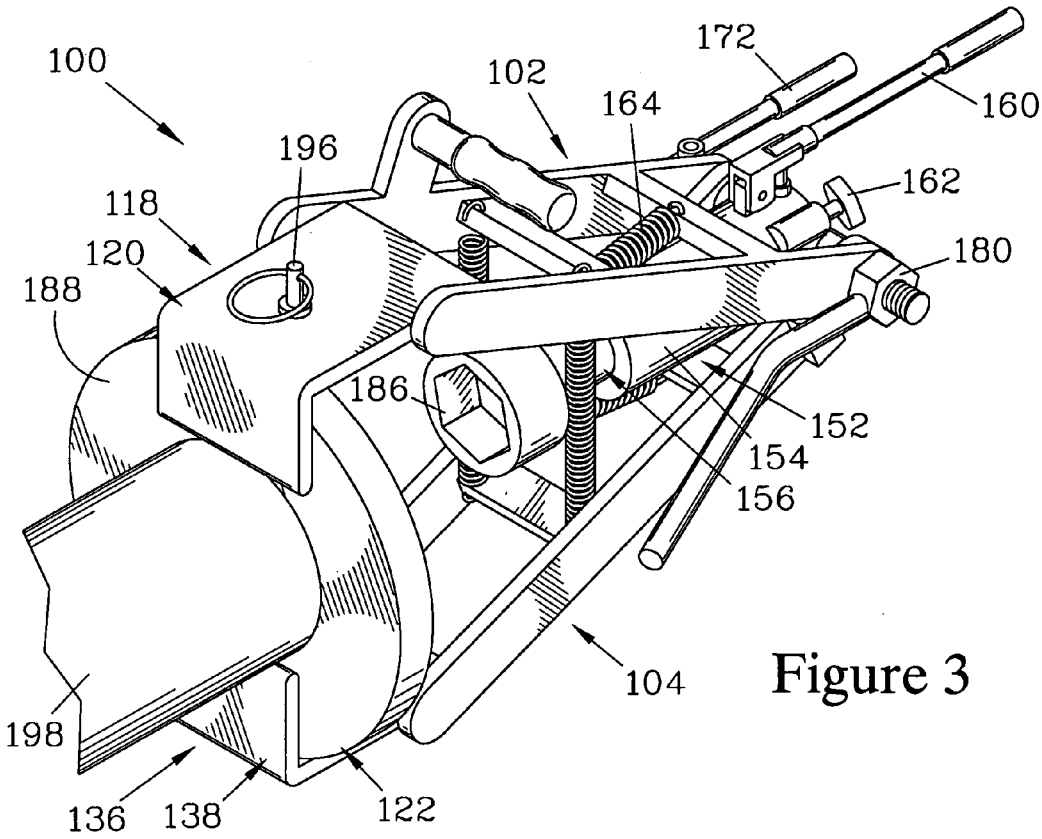
FIG. 3 illustrates the rotor puller shown in FIGS. 1 and 2 when the arm members have been released to allow the claws to springably engage the brake rotor. Once so positioned, a retaining pin is inserted into one of the claws to maintain the claws engaged with the rotor.

As illustrated, the brake rotor 122 has a planar rotor rear surface 188 (shown in FIG. 3). To forcibly engage the rotor rear surface 188, the first claw 120 is formed with a first claw surface 190 (shown in FIG. 6) that faces the first arm bar base ends 108. Similarly, the second claw 138 is formed with a second claw surface 192 (also shown in FIG. 6) that faces the second arm bar base ends 126. When the rotor puller 100 is placed over the brake rotor 122 (as shown in FIGS. 2–6), the first claw surface 190 and the second claw surface 192 are opposed to the rotor rear surface 188.

One of the claw plates (118, 136) is preferably provided with a retaining pin passage 194 therethrough, into which a retaining pin 196 can be inserted. In the rotor puller 100, the retaining pin passage 194 passes through the first claw plate 118, and is spaced apart from the first claw surface 190 a sufficient distance to accommodate the brake rotor 122 between the first claw surface 190 and the retaining pin 196.

FIGS. 2–6 illustrate the rotor puller 100 at various sequential stages as it is employed to remove the brake rotor 122 from a wheel hub 198 (both of which are shown in phantom in FIG. 2). As shown in FIG. 2, the hub adapter 186 is mounted onto the adapter mount 184 of the piston end 158. The hub adapter 186 is selected to mate with the specific model of the wheel hub 198 and is designed to forcibly engage the wheel hub 198 without causing damage. As noted above, the hub adapter 186 can typically be provided by a conventional axle nut socket that is designed for removing an axle nut to remove the wheel hub 198 from an axle (not shown) on which it is mounted. Alternatively, the hub adapter 186 can be any appropriate form of ram that is configured to forcibly engage surfaces of the wheel hub and/or the end of the axle while remaining small enough to allow the brake rotor 122 to be passed thereover, and which is provided with a socket shaped to accept the adapter mount 184 therein.

Figure 4:
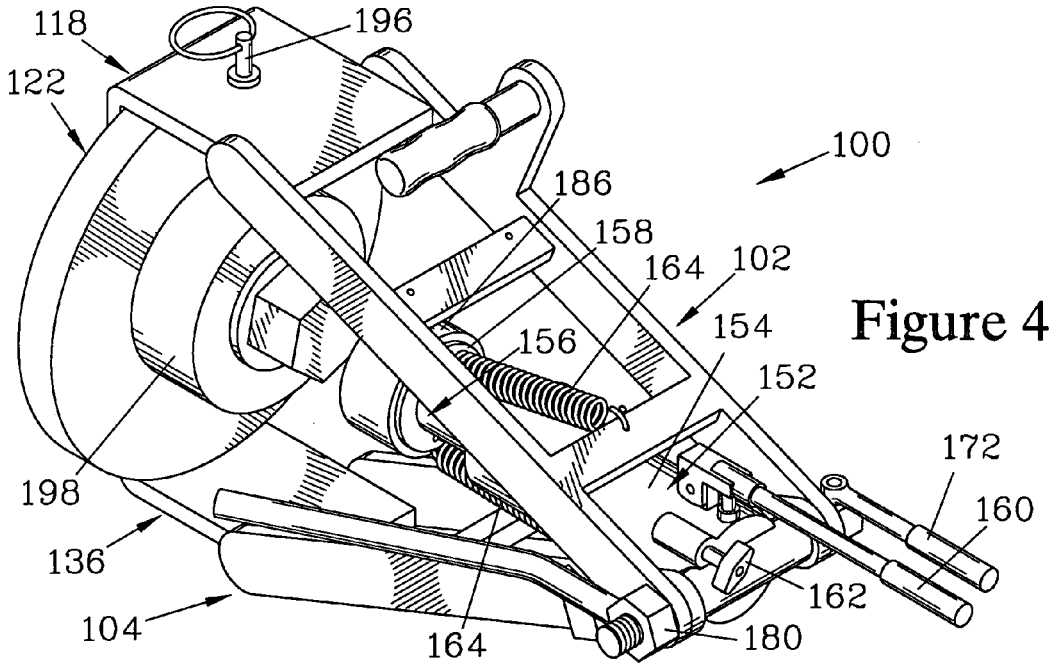
FIG. 4 is an isometric view showing the rotor puller shown in FIGS. 1–3 in the same position as shown in FIG. 3, but from a different angle to more clearly show the wheel hub and the brake rotor. The arm springs have been omitted to more clearly show the piston.

The user grasps the first arm handle 148 and the second arm handle 150 and pivots the first arm member 102 and the second arm member 104 apart, against the bias of the arm springs 146. The first arm member 102 and the second arm member 104 are separated until the first claw plate 118 and the second claw plate 136 can be passed over the brake rotor 122, as shown in FIG. 2. The first arm member 102 and the second arm member 104 are then allowed to pivot toward each other until the claw plates (118, 136) engage either the brake rotor 122 or the wheel hub 198, as shown in FIGS. 3 and 4 (the arm springs 146 are omitted in FIGS. 4–6 for clarity). As noted above, in this position, the first claw surface 190 and the second claw surface 192 face the rotor rear surface 188 of the brake rotor 122.

At this time, the retaining pin 196 is inserted into the retaining pin passage 194 in the first claw plate 118, trapping the brake rotor 122. As noted above, the retaining pin passage 194 is spaced apart from the first claw surface 190 sufficiently to accommodate the brake rotor 122. Together with the tension resulting from the arm springs 146, the retaining pin 196 maintains the rotor puller 100 in position on the brake rotor 122, freeing the hands of the user. The user then uses the pivot handle 172 to align the jack 152 with the wheel hub 198. The locking nut 180 is tightened once the jack 152 has been properly aligned.

Once the jack 152 is aligned with the wheel hub 198 and locked in position, the user makes certain that the pressure release knob 162 is turned to its closed position and operates the pump handle 160 to forcibly extend the piston 156 from the jack body 154. As the piston 156 extends, the hub adapter 186 is brought into forcible engagement with the wheel hub 198. Further extension of the piston 156 causes the claw surfaces (190, 192) to forcibly engage the rotor rear surface 188 of the brake rotor 122, and this forcible engagement causes any continued extension of the piston 156 to force the brake rotor 122 from the wheel hub 198, as shown in FIG. 5. Once the brake rotor 122 has been removed from the wheel hub 198, the pressure release knob 162 is turned to the open position, allowing the piston return springs 164 to retract the piston 156 to the position shown in FIG. 6. The pressure release knob 162 may then be turned to the closed position to ready the rotor puller 100 for another removal operation.

While the novel features of the present invention have been described in terms of particular embodiments and preferred applications, it should be appreciated by one skilled in the art that substitution of materials and modification of details obviously can be made without departing from the spirit of the invention.

What I claim is:

1. A brake rotor puller for removing a brake rotor from a wheel hub, the brake rotor puller comprising:

a pair of arm members pivotably attached with respect to each other about a pivot axis and terminating at claws configured to be forcibly engageable with the brake rotor;

spring means for biasing said arm members together; and a jack pivotably connected to said arm members so as to pivot with respect thereto about said pivot axis, said jack having an extendible piston which can be configured to forcibly engage the wheel hub;

said jack being operable to extend said piston toward said claws.

2. The A brake rotor puller for removing a brake rotor from a wheel hub, the brake rotor puller comprising:

a pair of arm members pivotably attached with respect to each other about a pivot axis and terminating at claws configured to be forcibly engageable with the brake rotor;

spring means for biasing said arm members together;

a jack pivotably connected to said arm members so as to pivot with respect thereto about said pivot axis, said jack having an extendible piston which can be configured to forcibly engage the wheel hub, said jack being operable to extend said piston toward said claws; and an arm handle affixed to each of said arm members and extending substantially parallel to said pivot axis.

3. The brake rotor puller of claim 2 further comprising:

a pivot handle attached with respect to said jack to allow a user to pivot said jack to a desired inclination with respect to said arm members; and means for maintaining said jack at a desired inclination with respect to at least one of said arm members.

4. The brake rotor puller of claim 3 further comprising:

piston return means for retracting said piston after extension.

5. The brake rotor puller of claim 4 wherein said spring means for biasing said arm members together further comprises:

a pair of arm springs connected between said arm members.

6. The brake rotor puller of claim 5 wherein said piston return means further comprises:

a piston return spring connected between said piston and each of said arm members.

7. The brake rotor puller of claim 6 further comprising:

an arm stop to limit the minimum angle between said arm members.

8. The brake rotor puller of claim 7 wherein said jack is a hydraulic bottle jack and said piston terminates at an adapter fitting configured to allow readily attaching a hub adapter thereto.

9. A brake rotor puller for removing a brake rotor from a wheel hub, the brake rotor puller comprising:

a pair of arm members pivotably attached with respect to each other about a pivot axis and terminating at claws configured to be forcibly engageable with the brake rotor;

spring means for biasing said arm members together;

a jack pivotably connected to said arm members so as to pivot with respect thereto about said pivot axis, said jack having an extendible piston which can be configured to forcibly engage the wheel hub, said jack being operable to extend said piston toward said claws; and piston return means for retracting said piston after extension.

10. The brake rotor puller of claim 9 wherein said piston return means further comprises:

a piston return spring connected between said piston and each of said arm members.

11. The brake rotor puller of claim 10 further comprising:

a pivot handle attached with respect to said jack to allow a user to pivot said jack to a desired inclination with respect to said arm members.

12. The brake rotor puller of claim 11 further comprising:

means for maintaining said jack at a desired inclination with respect to at least one of said arm members.

13. The brake rotor puller of claim 9 wherein said spring means for biasing said arm members together further comprises:

a pair of arm springs connected between said arm members.

14. The brake rotor puller of claim 9 further comprising:

an arm stop to limit the minimum angle between said arm members.

15. The brake rotor puller of claim 14 wherein said jack is a hydraulic bottle jack and said piston terminates at an adapter fitting configured to allow readily attaching a hub adapter thereto.

16. The brake rotor puller of claim 1 further comprising:

an arm handle affixed to each of said arm members.

17. The brake rotor puller of claim 1 wherein said spring means for biasing said arm members together further comprises:

a pair of arm springs connected between said arm members.

18. The brake rotor puller of claim 17 further comprising:

an arm stop to limit the minimum angle between said arm members.

19. The brake rotor puller of claim 1 further comprising:

a pivot handle attached with respect to said jack to allow a user to pivot said jack to a desired inclination with respect to said arm members.

20. The brake rotor puller of claim 19 further comprising:

means for maintaining said jack at a desired inclination with respect to at least one of said arm members.

* * * * *

UNITED STATES PATENT AND TRADEMARK OFFICE

CERTIFICATE OF CORRECTION

PATENT NO. : 6,925,696 B1
APPLICATION NO. : 10/779955
DATED : August 9, 2005
INVENTOR(S) : William A. Williams It is certified that error appears in the above-identified patent and that said Letters Patent is hereby corrected as shown below:

In claim 2, column 7 line 35, "The A brake rotor puller" should read --A brake rotor puller--.

Signed and Sealed this

Sixth Day of January, 2009

JON W. DUDAS
*Director of the United States Patent and Trademark Office*